US009074744B2

(12) United States Patent
Tsukamoto

(10) Patent No.: US 9,074,744 B2
(45) Date of Patent: Jul. 7, 2015

(54) VEHICULAR LAMP

(71) Applicant: KOITO MANUFACTURING CO., LTD., Tokyo (JP)

(72) Inventor: Hironori Tsukamoto, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 14/091,560

(22) Filed: Nov. 27, 2013

(65) Prior Publication Data

US 2014/0153273 A1 Jun. 5, 2014

(30) Foreign Application Priority Data

Dec. 3, 2012 (JP) ..... 2012-264555

(51) Int. Cl.
*F21S 10/00* (2006.01)
*F21S 8/10* (2006.01)

(52) U.S. Cl.
CPC ..... *F21S 10/005* (2013.01); *F21S 48/217* (2013.01); *F21S 48/2243* (2013.01); *F21S 48/215* (2013.01); *F21S 48/2268* (2013.01)

(58) Field of Classification Search
CPC ..... F21S 48/23; F21S 48/215; F21S 48/217; F21S 48/234; F21S 48/1145; F21S 48/1163; F21S 48/2243; F21S 48/2268; F21S 10/005
USPC ..... 362/84, 516–518, 297, 346
See application file for complete search history.

(56) References Cited

U.S. PATENT DOCUMENTS

2005/0041179 A1* 2/2005 Suzuki ..... 349/74
2009/0262545 A1 10/2009 Amelung et al.

FOREIGN PATENT DOCUMENTS

FR 2934353 A1 1/2010
JP 2011-150887 A 8/2011
WO 2011098430 A1 8/2011

OTHER PUBLICATIONS

Patent Abstracts of Japan, Publication No. 2011-150887 dated Aug. 4, 2011 (1 page).
Extended European Search Report issued in counterpart European application No. 13195392.9 mailed Mar. 27, 2014 (6 pages).

* cited by examiner

*Primary Examiner* — Thomas M Sember
(74) *Attorney, Agent, or Firm* — Osha Liang LLP

(57) ABSTRACT

A vehicular lamp includes a transparent planar light emitting body including a first light emitting surface and a second light emitting surface which face each other, a first reflector and a second reflector. The transparent planar light emitting body emits light from the first light emitting surface and the second light emitting surface. The first reflector reflects light from the first light emitting surface to the front. The second reflector reflects light from the second light emitting surface to the front.

5 Claims, 5 Drawing Sheets

VEHICULAR LAMP

CROSS-REFERENCE TO RELATED APPLICATION(S)

The present application claims the benefit of priority of Japanese Patent Application No. 2012-264555 filed on Dec. 3, 2012. The disclosures of the application are incorporated herein by reference.

BACKGROUND

1. Technical Field

The present disclosure relates to a vehicular lamp.

2. Related Art

There have been proposed vehicular lamps which employ a planar light emitting body in order to make the vehicular lamp thin and small in size (for example, refer to Patent Literature 1).

[Patent Literature 1] JP-A-2011-150887

In recent years, users have a wide variety of preferences for vehicular lamps, and there are now demands for vehicular lamps having novel illuminated appearances which are different from those of the conventional vehicular lamps.

SUMMARY

One or more embodiments of the invention provide a vehicular lamp having a novel illuminated appearance.

A vehicular lamp according to one or more embodiments of the invention, comprises:

a transparent planar light emitting body including a first light emitting surface and a second light emitting surface which face each other, the transparent planar light emitting body configured to emit light from the first light emitting surface and the second light emitting surface;

a first reflector configured to reflect light from the first light emitting surface to the front; and a second reflector configured to reflect light from the second light emitting surface to the front.

According to one or more embodiments of the invention, the transparent planar light emitting body may comprise a transparent organic EL panel.

According to one or more embodiments of the invention, at least one of the first reflector and the second reflector may have a paraboloidal reflecting surface.

According to one or more embodiments of the invention, the transparent planar light emitting body may have a plurality of areas of the first light emitting surface and the second light emitting surface which are illuminated selectively so as to emit light therefrom.

According to one or more embodiments of the invention, it is possible to provide a vehicular lamp having a novel illuminated appearance.

DETAILED DESCRIPTION

Figure 1:
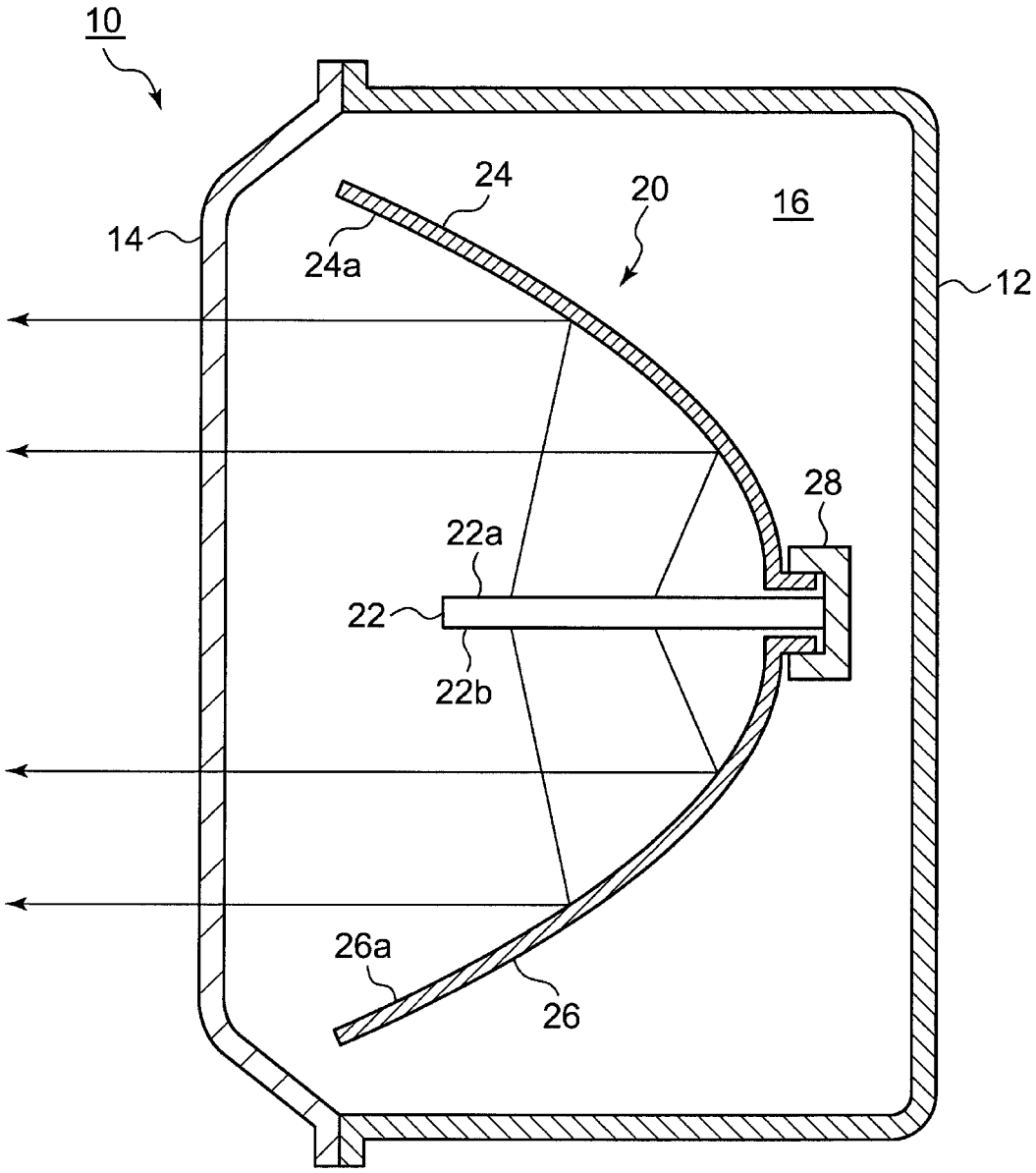
FIG. 1 is a vertical sectional view of a vehicular lamp according to one or more embodiments of the invention.

Hereinafter, referring to the drawings, a vehicular lamp according to embodiments of the invention will be described in detail. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

FIG. 1 is a vertical sectional view of a vehicular lamp 10 according to one or more embodiments of the invention. As shown in FIG. 1, the vehicular lamp 10 includes a lamp body 12, a transparent front cover 14 which covers a front opening portion in the lamp body 12, and a lamp unit 20 which is provided within a lamp chamber 16 defined by the lamp body 12 and the front cover 14.

Figure 2:
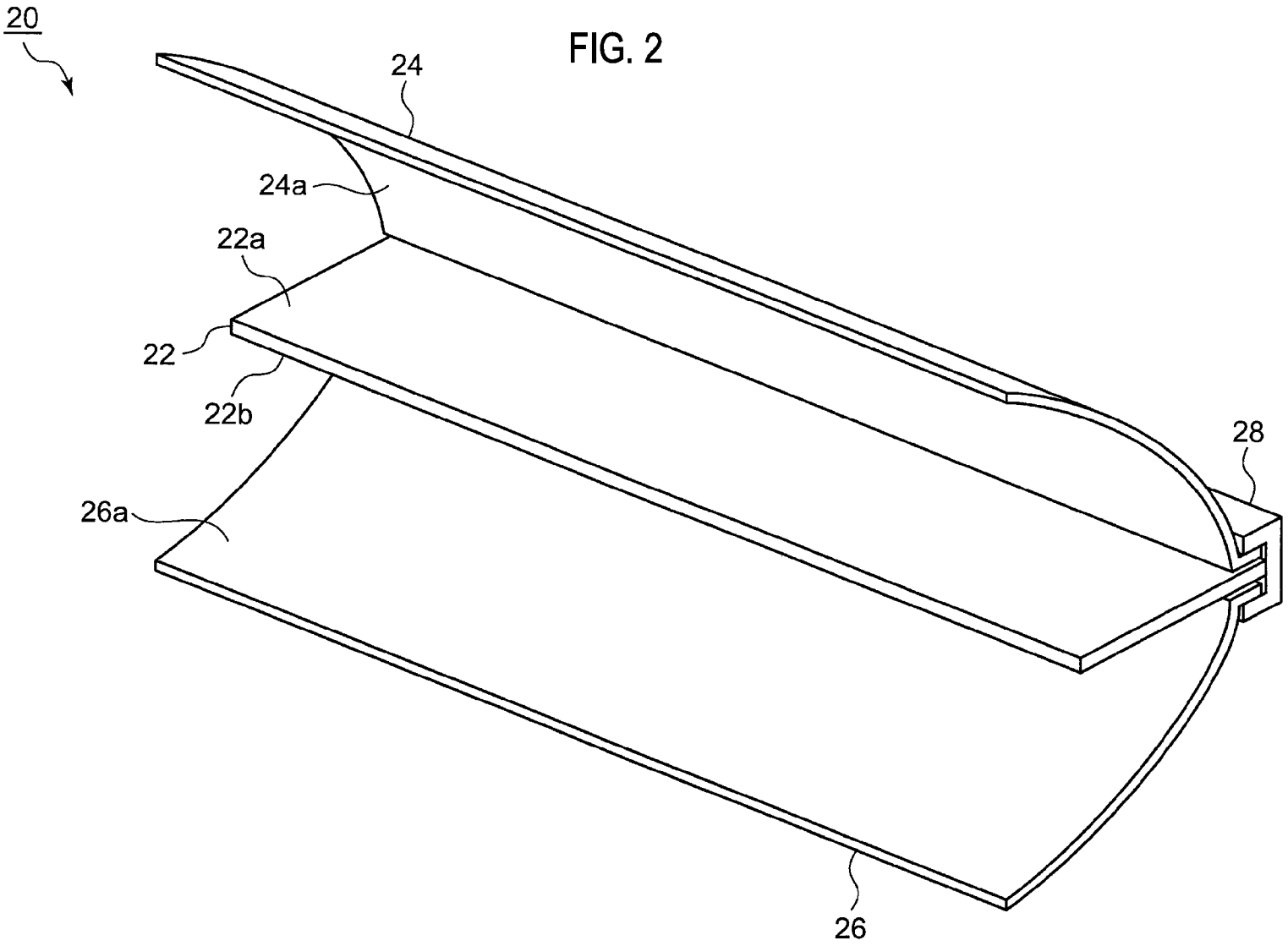
FIG. 2 is a perspective view of a lamp unit.

FIG. 2 is a perspective view of the lamp unit 20. As shown in FIGS. 1 and 2, the lamp unit 20 includes a transparent organic EL (Electro Luminescence) panel 22 as a transparent planar light emitting body, a first reflector 24, a second reflector 26 and a supporting member 28 which supports the transparent organic EL panel 22, the first reflector 24 and the second reflector 26.

Figure 3:
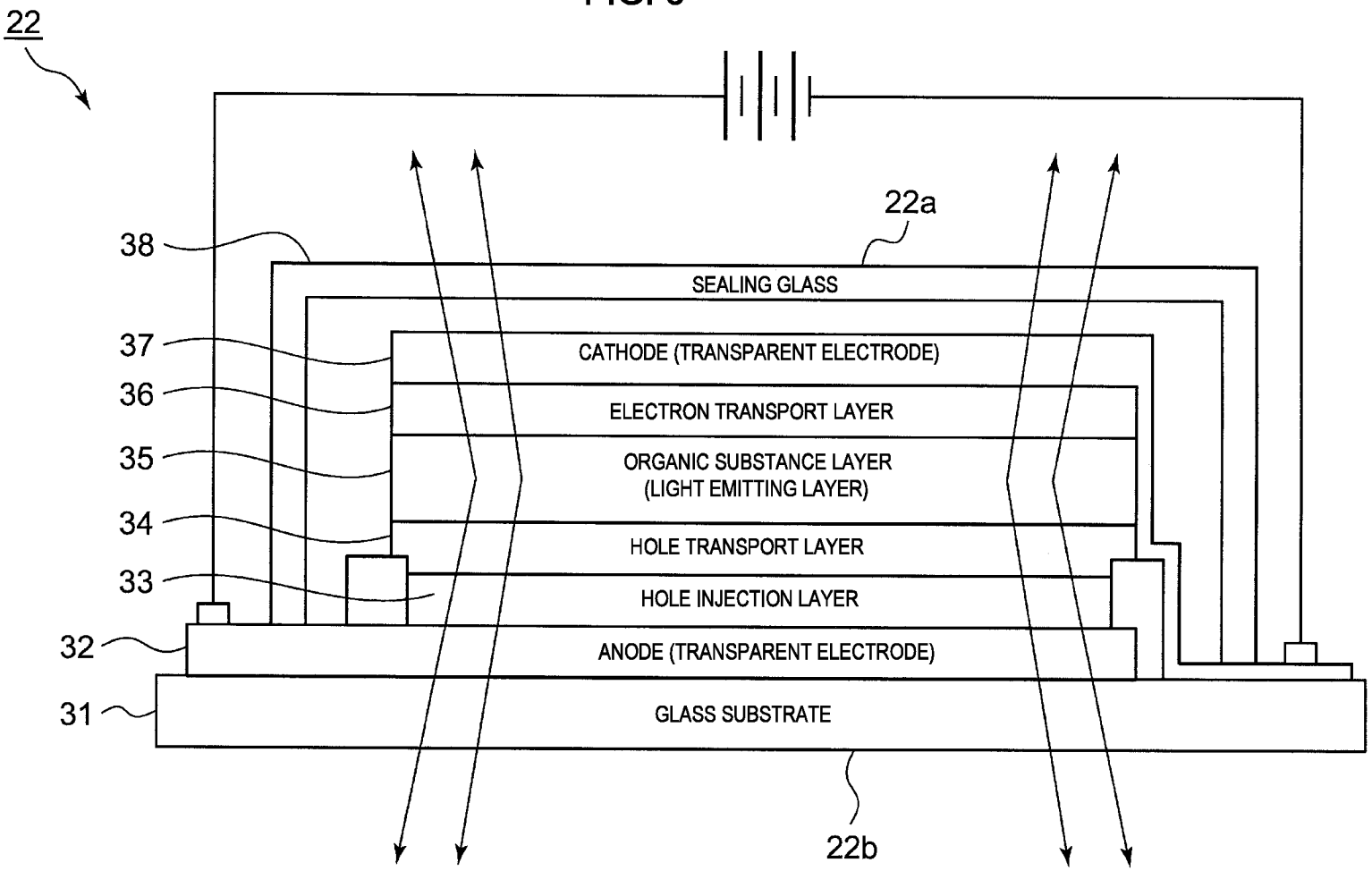
FIG. 3 is a diagram illustrating the configuration of a transparent organic EL panel.

FIG. 3 is a diagram illustrating the configuration of the transparent organic EL panel 22. As shown in FIG. 3, the transparent organic EL panel 22 is made by laminating an anode 32, a hole injection layer 33, a hole transport layer 34, an organic substance layer 35, an electron transport layer 36 and a cathode 37 on a glass substrate 31. In addition, the transparent organic EL panel 22 includes a sealing glass 38 which seals therein the anode 32, the hole injection layer 33, the hole transport layer 34, the organic substance layer 35, the electron transport layer 36 and the cathode 37.

In a normal organic EL panel, a transparent electrode of ITO or the like is used for the anode 32 and a metallic electrode is used for the cathode 37. In the transparent organic EL panel 22 according to one or more embodiments, in order to fabricate a transparent organic EL panel, a transparent electrode is used not only for the anode 32 but also for the cathode 37. The cathode 37 may be formed of indium tin oxide (ITO), for example.

When a voltage is applied to the transparent organic EL panel 22 shown in FIG. 3, holes are injected from the anode 32, and electrons are injected from the cathode 37. Then, the holes and the electrons are combined together in the organic substance layer 35 to generate energy, and a phosphorous organic compound in the organic substance layer 35 is excited by the energy so generated to be luminous. In light emitted in the organic substance layer 35, light directed towards the cathode 37 passes through the shielding glass 38 and is then emitted to an outside thereof, while light directed towards the anode 32 passes through the glass substrate 31 and is then emitted to an outside thereof.

In this way, the transparent organic EL panel 22 is designed to function as a planar light emitting body which emits light from both of a sealing glass surface (referred to as a "first light emitting surface") 22*a* and a glass substrate surface (referred to as a "second light emitting surface") 22*b* which face each other. In addition, since the transparent electrode is used as the cathode 37, the transparent organic EL panel 22 is transparent.

Returning to FIGS. 1 and 2, the first reflector 24 and the second reflector 26 will be described. As shown in FIGS. 1 and 2, the first reflector 24 and the second reflector 26 have a paraboloidal first reflecting surface 24*a* and a paraboloidal second reflecting surface 26*a*, respectively. As shown in FIG. 1, sections of the first reflecting surface 24*a* and the second reflecting surface 26*a* which are taken normal to directions in which the first reflecting surface 24*a* and the second reflecting surface 26*a* extend each have a parabolic shape.

The first reflector 24 is disposed so that the first reflecting surface 24*a* covers the first light emitting surface 22*a* of the transparent organic EL panel 22 from thereabove. Additionally, the second reflector 26 is disposed so that the second reflecting surface 26*a* covers the second light emitting surface 22*b* of the transparent organic EL panel 22 from therebelow. The first reflector 24 and the second reflector 26 are disposed so that the first reflecting surface 24*a* and the second reflecting surface 26*a* face each other across the transparent organic EL panel 22.

As shown in FIG. 1, light from the first light emitting surface 22*a* of the transparent organic EL panel 22 is reflected to the front of the lamp on the first reflecting surface 24*a*, while light from the second light emitting surface 22*b* is reflected to the front of the lamp on the second reflecting surface 26*a*. In one or more embodiments, the first reflecting surface 24*a* of the first reflector 24 and the second reflecting surface 26*a* of the second reflector 26 are each formed into a paraboloidal surface, whereby light surface emitted in the first light emitting surface 22*a* and light surface emitted in the second light emitting surface 22*b* are reflected as parallel light on the first reflecting surface 24*a* and the second reflecting surface 26*a*, respectively. In one or more embodiments, while the reflecting surfaces 24*a*, 26*a* are each formed into the paraboloidal surface, only one of reflecting surfaces 24*a*, 26*a* may be formed into the paraboloidal surface.

The vehicular lamp 10 which is configured as described above employs the transparent organic EL panel 22 as a light source, and therefore, it is difficult to find the existence of the light source. It is possible to realize a way of illumination which makes the first reflecting surface 24*a* of the first reflector 24 and the second reflecting surface 26*a* of the second reflector 26 look as it were they are illuminated without the existence of a light source. Consequently, according to the vehicular lamp 10 of one or more embodiments, it is possible to provide such a novel illuminated appearance that the conventional vehicular lamps employing the conventional illumination methods have never realized before.

In one or more embodiments, the light source in which surface emission is realized in both surfaces of a single organic EL panel is made up by employing the transparent organic EL panel. This configuration enables the reduction in size, weight and cost of the light source, compared with a light source which is made up, for example, by affixing two organic EL panels together so that light is emitted from both surfaces of the affixed organic EL panels.

Figure 4:
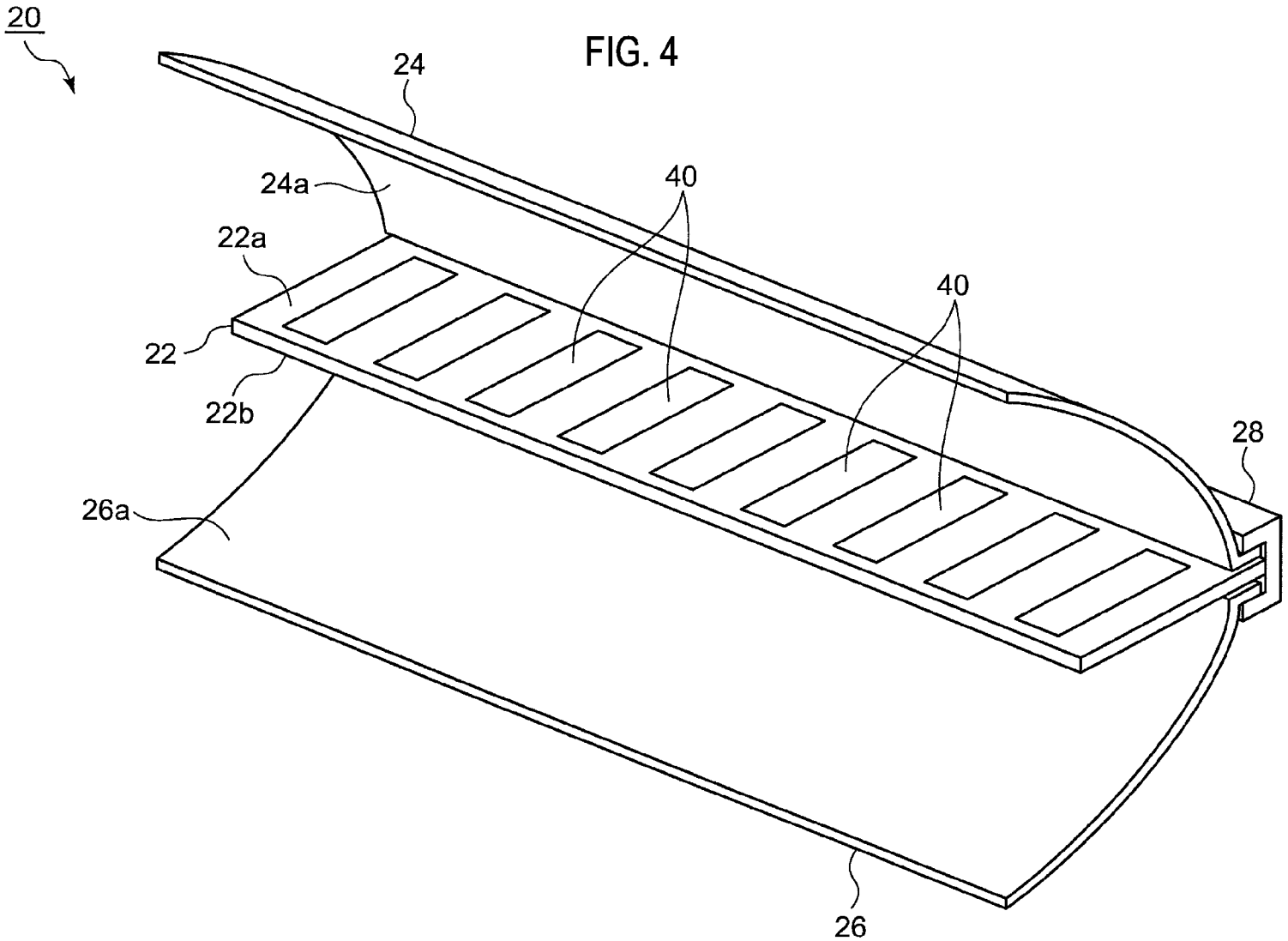
FIG. 4 is a diagram illustrating a vehicular lamp according to one or more embodiments of the invention.

FIG. 4 is a diagram illustrating a vehicular lamp according to one or more embodiments of the invention. As shown in FIG. 4, a transparent organic EL panel 22 may be configured so that predetermined areas 40 of a first light emitting surface 22*a* and a second light emitting surface 22*b* can be illuminated selectively to emit light therefrom. FIG. 4 shows an example in which a plurality of areas 40 are formed into a straight line. The areas 40 are formed on the first light emitting surface 22*a* and the second light emitting surface 22*b* by forming the organic substance layer (light emitting layer) 35 of the transparent organic EL panel 22 into a straight line. In this way, the first light emitting surface 22*a* and the second light emitting surface 22*b* are not illuminated totally but are illuminated at selected areas 40, whereby it is possible to realize an illumination in which a pattern corresponding to the shape of the group of selected areas 40 appears from each of the first reflecting surface 24*a* and the second reflecting surface 26*a* which are blank. In this way, according to the vehicular lamp according to one or more embodiments, it is possible to accent the way of illumination of the first reflecting surface 24*a* and the second reflecting surface 26*a*, thereby making it possible to provide a novel illuminated appearance of the vehicular lamp.

In the vehicular lamp shown in FIG. 4, a configuration may be adopted in which some of the areas 40 are used as a light source of a tail lamp, others of the areas 40 are used as a light source of a stop lamp, and the remaining of the areas 40 are used as a light source of a turn signal. As this occurs, the single transparent organic EL panel 22 can be used as the light sources of the plurality of lamps. As a result, it is possible to realize a reduction in size of a rear combination lamp, for example.

Figure 5:
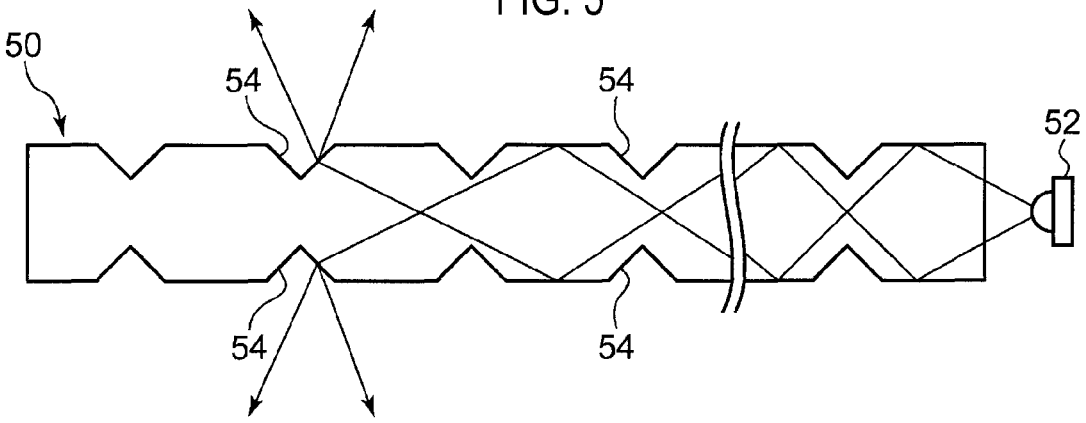
FIG. 5 shows a light guide which can be used as a transparent planar light emitting body.

In one or more embodiments, while the transparent organic EL panel is used as the transparent planar light emitting body, the planar light emitting body is not limited to the transparent organic EL panel. FIG. 5 shows a light guide which can be used as a transparent planar light emitting body. The light guide 50 shown in FIG. 5 is formed in the shape of panel. The light guide 50 receives light from an LED 52 which functions as a light source at a side surface and guides the light that has so entered the light guide 50 while reflecting it repeatedly in an interior thereof. Groove portions 54 are formed in upper and lower surfaces of the light guide 50 so that the light is allowed to be emitted to the outside of the light guide 50. The vehicular lamp 10 shown in FIG. 1 may be made up by replacing the transparent organic EL panel 22 with the light guide 50 shown in FIG. 5.

While the invention has been described based upon embodiments, the embodiments illustrate only the examples of the invention. Therefore, it is understood by those skilled in the art to which the invention pertains that various modified examples will be possible by combining the constituent elements and treatment processes in various ways and that the resulting modified examples will also fall within the scope of the invention. Accordingly, the scope of the invention should be limited only by the attached claims.

What is claimed is:

1. A vehicular lamp comprising:

a transparent planar light emitting body including a first light emitting surface and a second light emitting surface which face each other, the transparent planar light emitting body configured to emit light from the first light emitting surface and the second light emitting surface;

a first reflector configured to reflect light from the first light emitting surface to a front; and a second reflector configured to reflect light from the second light emitting surface to the front, wherein the transparent planar light emitting body has a plurality of areas of the first light emitting surface and the second light emitting surface which are illuminated selectively so as to emit light therefrom.

2. The vehicular lamp according to claim 1, wherein the transparent planar light emitting body comprises a transparent organic EL panel.

3. The vehicular lamp according to claim 2, wherein the transparent organic EL panel comprises a transparent electrode serving as anode, a transparent electrode serving as cathode, and a light emitting layer sandwiched between the transparent electrodes.

4. The vehicular lamp according to claim 1, wherein at least one of the first reflector and the second reflector has a paraboloidal reflecting surface.

5. The vehicular lamp according to claim 1, wherein the transparent planar light emitting body comprises a light guide.

* * * * *